US005277506A

United States Patent [19]

Oda

[11] Patent Number: 5,277,506

[45] Date of Patent: Jan. 11, 1994

[54] PRINTER WITH PAPER WIDTH DETECTOR

[75] Inventor: Akira Oda, Shizuoka, Japan

[73] Assignee: Tokyo Electric Co., Ltd., Tokyo, Japan

[21] Appl. No.: 944,274

[22] Filed: Sep. 14, 1992

[30] Foreign Application Priority Data

Sep. 18, 1991 [JP] Japan ..... 3-237893

[51] Int. Cl.[5] ..... B41J 13/30

[52] U.S. Cl. ..... 400/279; 400/633

[58] Field of Search ..... 400/630–634, 400/279; 271/255, 171, 265, 258, 236–240

[56] References Cited

U.S. PATENT DOCUMENTS

| | | | |
|---|---|---|---|
| 4,591,871 | 5/1986 | Ohta | 400/708 |
| 4,841,859 | 6/1989 | Watanabe | 271/238 |
| 5,110,106 | 5/1992 | Matsumura | 271/171 |
| 5,127,752 | 7/1992 | Courtney | 400/708 |

FOREIGN PATENT DOCUMENTS

| | | | |
|---|---|---|---|
| 52-58614 | 5/1977 | Japan | 400/708 |
| 56-25488 | 3/1981 | Japan | 400/708 |
| 14070 | 1/1982 | Japan | 400/633 |
| 98381 | 6/1982 | Japan | 400/633 |
| 57375 | 3/1986 | Japan | 400/633 |
| 8081 | 1/1989 | Japan | 400/633 |
| 317778 | 12/1989 | Japan | 400/633 |
| 2170934 | 8/1986 | United Kingdom . | |

OTHER PUBLICATIONS

Patent Abstracts of Japan, vol. 11, No. 074, (M-568), Mar. 6, 1987, JP-A-A61 228 977, Oct. 13, 1986, S. Chikahiro.

Patent Abstracts of Japan, vol. 10, No. 92, (M-468)(2149), Apr. 9, 1986, JP-A-60 230 885, Nov. 16, 1985, M. Suzuki.

Patent Abstracts of Japan, vol. 14, No. 196, (M-964)(4139), Apr. 20, 1990, AM 63-186823, JP-A-20 38 078, Feb. 7, 1990, K. Tsugita.

Patent Abstracts of Japan, vol. 10, No. 130, (M-478)(2187), May 14, 1986, JP-A-60 257 278, Dec. 19, 1985, K. Noda.

*Primary Examiner*—David A. Wiecking
*Assistant Examiner*—Steven S. Kelley
*Attorney, Agent, or Firm*—Oblon, Spivak, McClelland, Maier & Neustadt

[57] ABSTRACT

A movable plate (7) of a paper lateral ends positioning mechanism (5) is located on the side of a home position (HP), and a fixed plate (6) of the paper lateral ends positioning mechanism (5) is located on the other side opposite to the home position (HP) side. A paper width detecting device (10) is so designed as to detect a width (W1, W2) of a printing paper (P) by subtracting from a known distance (C1) a quantity of movement (X) of a carrier (3) from the home position (HP) at the time when a lateral end of the printing paper (P) on the home position (HP) side is detected by a paper lateral end sensor (11).

3 Claims, 4 Drawing Sheets

PRINTER WITH PAPER WIDTH DETECTOR

FIELD OF THE INVENTION AND RELATED ART STATEMENT

The present invention relates to a printer having a paper lateral ends positioning mechanism and paper width detecting means to effect printing as controlling a quantity of movement of a carrier from a home position.

The fundamentals of paper width detection in a conventional printer of the above type will be described with reference to FIG. 5.

As shown in FIG. 5, a carrier 3 is slidably mounted on a guide bar 2 transversely extending across a printer frame 1. The carrier 3 is adapted to be reciprocated along the guide bar 2 by a motor (not shown). A printing head (not shown) is mounted on the carrier 3. The printing head is adapted to be driven in concert with movement of the carrier 3, a quantity of which being controlled, thus effecting printing.

The movement quantity of the carrier 3 is accurately detected by movement quantity detecting means 30.

In general, the movement quantity detecting means 30 is of an incremental type from the primary viewpoints of a reduction in cost and an expansion of applicability, which is constituted of a scale 31 having optical slits or the like and a detector 32 mounted on the carrier 3 so as to face the scale 31. Accordingly, home position detecting means 20 is provided, so as to clear a count value of the movement quantity detecting means 30 to zero.

The home position detecting means 20 is constituted of a signal generator 21 such as a proximity switch or a limit switch mounted on the carrier 3 and a detection member 22 fixed at a suitable position so as to be detected by the signal generator 21.

Thus, the printing operation is effected under the condition where the quantity of movement of the carrier 3 from a home position HP as a reference position.

It is also important to preliminarily acknowledge a width W1 (W2) of a sheet of paper P to be printed on because print data transferred from a host computer, for example, must be developed according to a size of the paper P. The acknowledgment of the width W1 (W2) of the paper P is effected by paper width detecting means 10.

Generally, printing is started from a print start position PSP indented by a predetermined distance C2 from a lateral end of the paper P on the home position HP side. Accordingly, when the carrier 3 is started moving from the home position HP, the printing can be started at once.

Further, a paper lateral ends positioning mechanism 5 consisting of a fixed plate 6 and a movable plate 7 is provided to prevent the paper P from departing from an effective printing area. The fixed plate 6 is located on the home position HP side, and the movable plate 7 is laterally movably located on the other side opposite to the home position HP side. Accordingly, the print start position PSP can be set at a fixed position irrespective of any one of the widths W1 and W2 of the paper P.

The paper width detecting means 10 is comprised of a paper lateral end sensor 11 mounted on the carrier 3 and arithmetic and memory means (CPU, ROM, etc.) for obtaining the value W1 (W2) ($=X-C1$) by subtracting a predetermined known distance C1 from the home position HP to the fixed plate 6 contacting a left end of the paper P, from a quantity of movement X of the carrier 3 from the home position HP detected by the movement quantity detecting means 30 when a right end of the paper P is detected by the paper lateral end sensor 11.

However, in order to detect the width W1 (W2) of the paper P set by the paper lateral ends positioning mechanism 5 (6, 7), the carrier 3 must be necessarily moved from the home position HP to the right as viewed in FIG. 5 until the right end of the paper P is detected by the paper lateral end sensor 11, and must then be necessarily returned to the home position HP.

In the prior art as mentioned above, the fixed plate 6 and the movable plate 7 are located on the home position HP side and the other side opposite to the home position HP side, respectively, intentionally and conventionally for the purpose of setting the print start position PSP at a fixed position irrespective of the paper width. However, in recent years, there is the tendency that a higher printing speed has been demanded and an effective printing area has become larger. Accordingly, a period of time of reciprocation of the carrier 3 for the detection of the paper width becomes a time loss, which will largely influence actual printing.

SUMMARY OF THE INVENTION

It is accordingly a first object of the present invention to greatly reduce the paper width detection time.

It is a second object of the present invention to realize a high printing speed.

It is a third object of the present invention to reliably prevent printing on sheets of paper having any widths other than a prescribed width.

According to the present invention, there is provided in a printer having a paper lateral ends positioning mechanism consisting of a fixed plate and a movable plate and paper width detecting means including a paper lateral end sensor to effect printing as controlling a quantity of movement of a carrier from a home position; the improvement wherein the movable plate is located on the side of the home position, the fixed plate is located on the other side opposite to the home position side, and the paper width detecting means is so designed as to detect a width of a printing paper by subtracting the quantity of movement of the carrier from the home position at the time when a lateral end of the printing paper on the home position side is detected by the paper lateral end sensor, from a known distance between the home position and the fixed plate.

With this arrangement, the fixed plate is located on the other side opposite to the home position side, so that a distance from the home position to a lateral end (e.g., a right end) of the paper contacting the fixed plate is a known fixed value.

When the carrier is moved from the home position to a left end of the paper contacting the movable plate located close to the home position, the paper lateral end sensor is turned on.

The paper width is easily detected by the paper width detecting means in such a manner that the quantity of movement of the carrier from the home position at the time when the left end of the paper is detected by the paper lateral end sensor is subtracted from the known fixed distance from the home position to the right end of the paper.

Accordingly, the paper width can be automatically detected quickly and accurately only by slightly moving the carrier from the home position in comparison with the prior art wherein the carrier must be reciprocated a distance more than the paper width for the detection of the paper width.

Thus, the paper width detection time can be reduced to thereby realize a high printing speed.

Additionally, a print start position can be easily set only by adding a fixed value to the movement quantity of the carrier at the time when the left end of the paper is detected. Accordingly, a period of time of computation for setting of the print start position in the present invention is not so different from that in the prior art.

As described above, according to the present invention, the movable plate of the paper lateral ends positioning mechanism is located on the home position side, and the fixed plate of the paper lateral ends positioning mechanism is located on the other side opposite to the home position side. In connection with this arrangement, the paper width detecting means is so designed as to automatically detect the paper width by subtracting from the known distance the movement quantity of the carrier from the home position at the time when the lateral end of the paper on the home position side is detected by the paper lateral end sensor. Accordingly, the paper width detection time can be greatly reduced to thereby realize a high printing speed.

DETAILED DESCRIPTION OF THE PREFERRED EMBODIMENTS

There will now be described a preferred embodiment of the present invention with reference to FIGS. 1 to 4.

Figure 2:
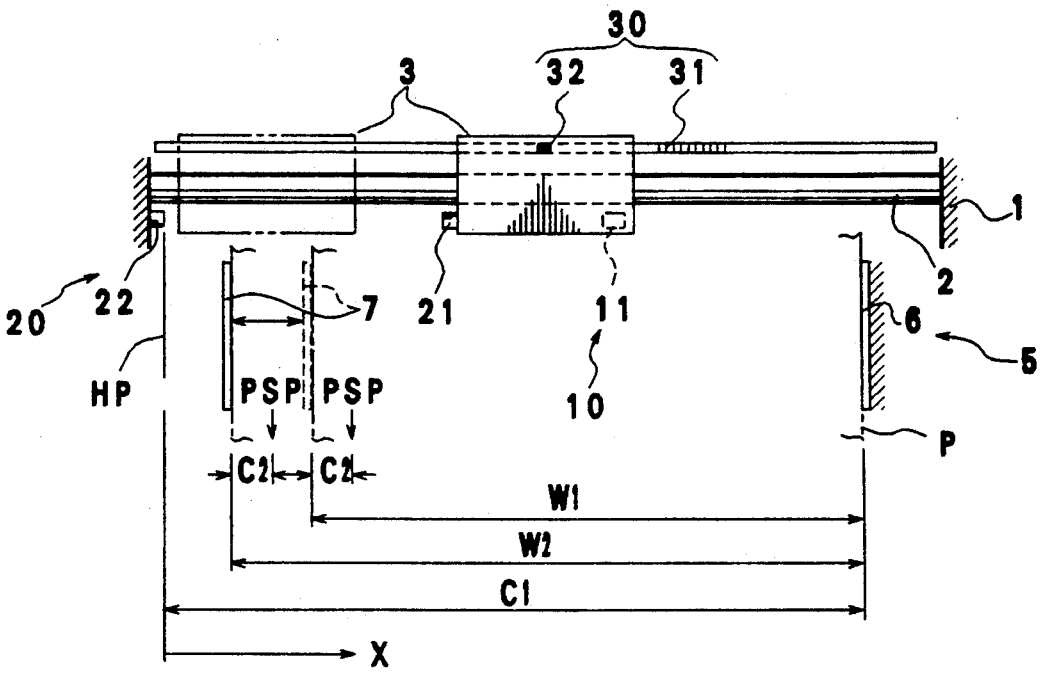
FIG. 2 is a schematic plan view illustrating a paper width detecting operation in the preferred embodiment.
Figure 3:
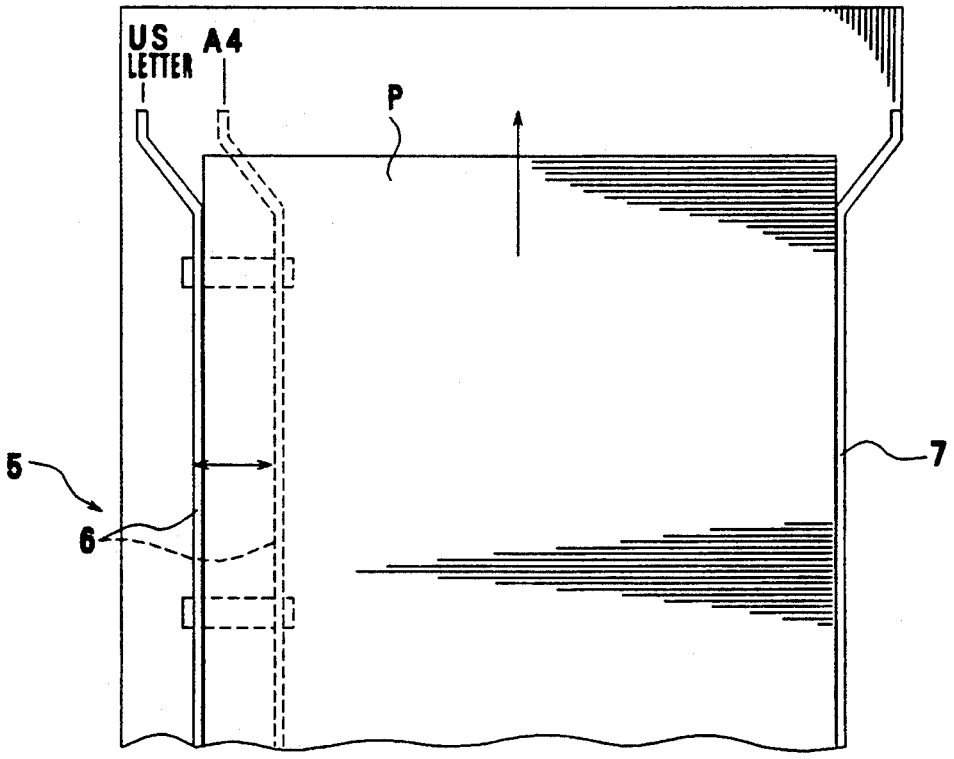
FIG. 3 is a plan view of a paper lateral ends positioning mechanism in the preferred embodiment.
Figure 5:
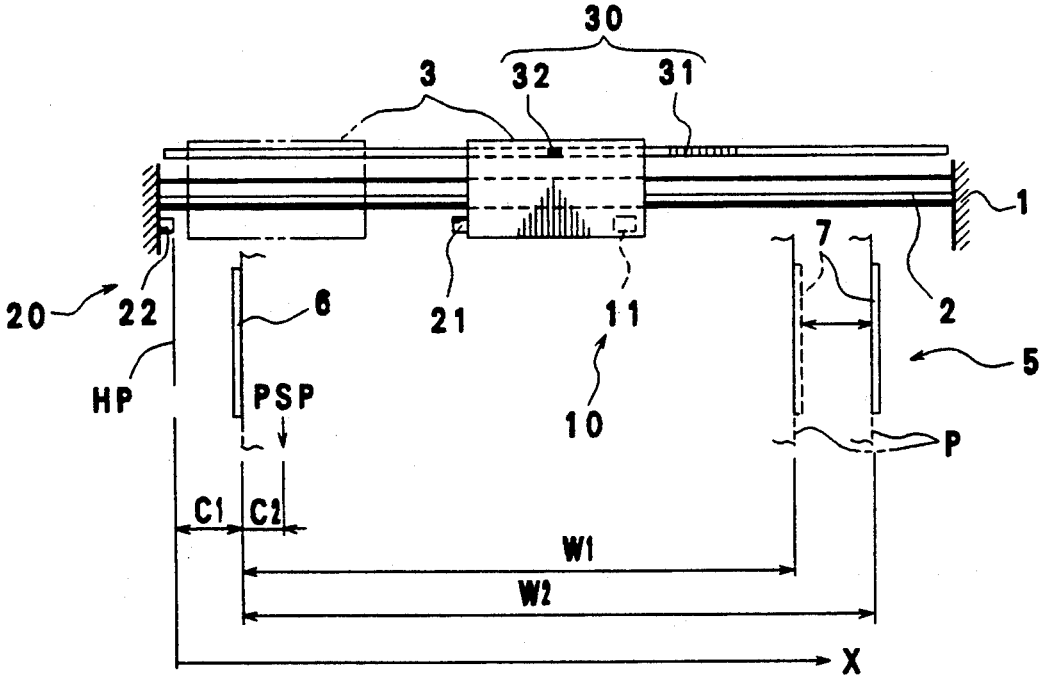
FIG. 5 is a schematic plan view illustrating a paper width detecting operation in the prior art.

As shown in FIG. 2, the printer according to the preferred embodiment has substantially the same basic construction (including parts designated by reference numerals 1, 2, 3, 5, 10, 20, 30, etc.) as that in the prior art shown in FIG. 5 with the exception that the locations of the fixed plate 6 and the movable plate 7 of the paper lateral ends positioning mechanism 5 are reversed to those in the prior art as apparent from FIGS. 2 and 3 in comparison with FIG. 5. Further, it is featured in the present invention that the paper width is detected by the paper width detecting means 10 under the condition where the lateral end of the paper P on the home position HP side has been detected by the paper lateral end sensor 11. Accordingly, a high printing speed can be achieved.

In the following description, the same or common parts as those in the prior art shown in FIG. 5 will be designated by the same reference numerals, and the explanation thereof will be simplified or omitted.

Figure 1:
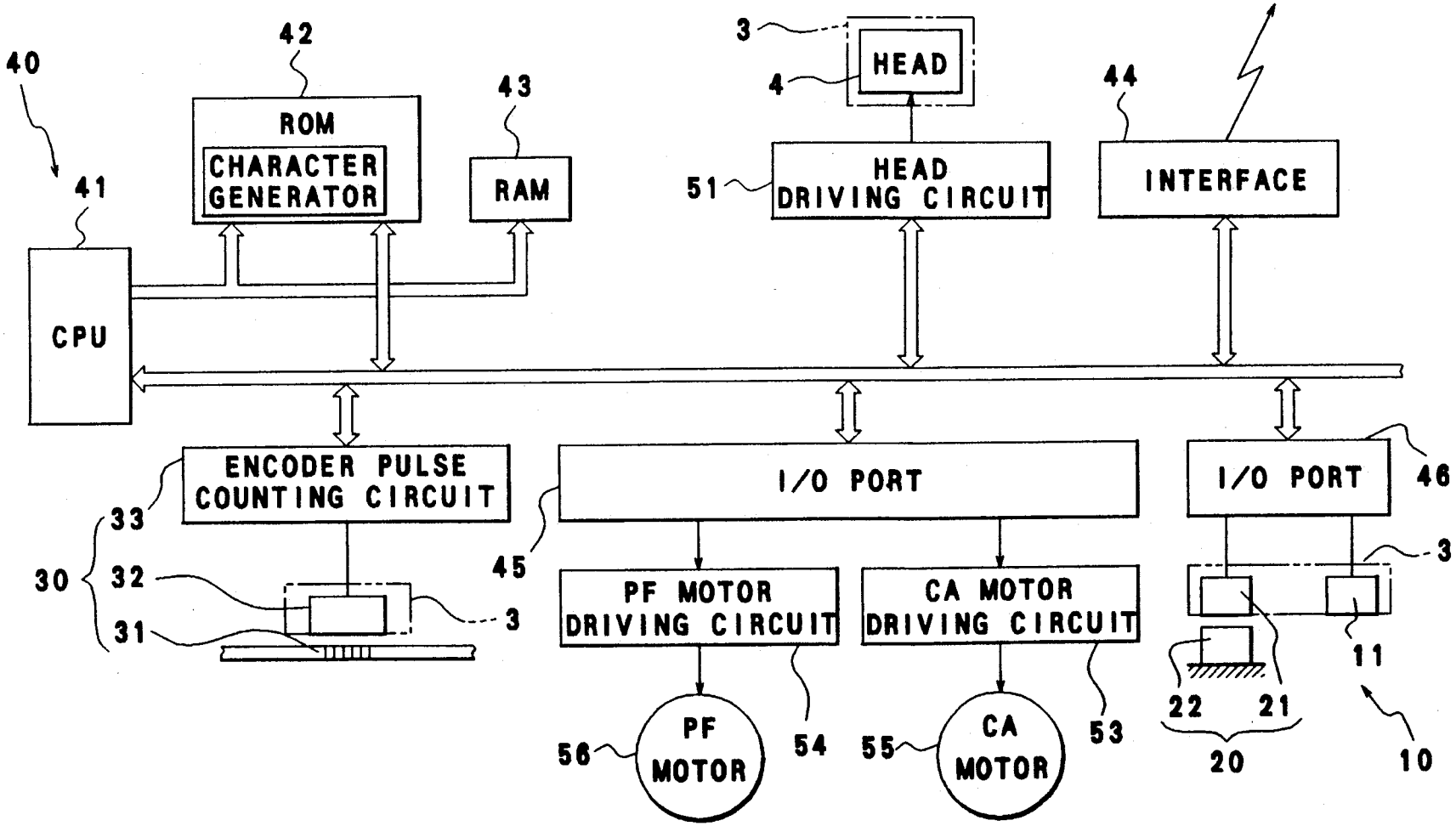
FIG. 1 is a schematic block diagram illustrating a general construction of a preferred embodiment of the present invention.

Referring to FIG.1, reference numeral 40 generally designates a control section for controlling the printer as a whole. The control section 40 is constituted of a CPU 41, ROM 42, RAM 43, I/O ports 45 and 46, and interface 44.

Connected to the control section 40 is a movement quantity detecting means 30 consisting of an encoder pulse counting circuit 33, a detector 32 and a scale 31, for detecting a quantity of movement X of a carrier 3 from a home position HP. A head driving circuit 51 for a printing head 4 is also connected to the control section 40. Further, a driving circuit 53 for a CA motor 55 for feeding the carrier 3 and a driving circuit 54 for a PF motor 56 for feeding the paper P are connected through the I/O port 45 to the control section 40.

Further, connected through the I/O port 46 to the control section 40 are a signal generator 21 constituting home position detecting means 20 inclusive of a detection member 22 to be detected by the signal generator 21 and a paper lateral end sensor 11 constituting paper width detecting means 10.

As shown in FIGS. 1 and 2, all of the printing head 4, the paper lateral end sensor 11, the signal generator 21 and the detector 32 are mounted on the carrier 3.

As shown in FIGS. 2 and 3, the movable plate 7 of the paper lateral ends positioning mechanism 5 is adapted to be laterally moved to change its position, and in this preferred embodiment, a sheet of paper P having a US letter size or an A4 size, for example and for simplicity of explanation, is adapted to be set by the fixed plate 6 and the movable plate 7.

As shown in FIG. 2, a distance between the home position HP and the fixed plate 6 contacting a right end of the paper P is a known fixed value C1. Further, a print start position PSP is set at a position indented by a fixed distance C2 from a left end of the paper P.

Further, W1 represents a width of the paper P having the US letter size; W2 represents a width of the paper P having the A4 size; and X represents a quantity of movement of the carrier 3 from the home position HP.

The known distance C1, the widths W1 and W2, and the fixed distance C2 are preliminarily stored as fixed data in the ROM 42. Alternatively, these values may be stored in the RAM 43.

The movement quantity X of the carrier 3 from the home position HP is detected by the movement quantity detecting means 30 at the time when the left end of the paper P is detected by the paper lateral end sensor 11, and is stored into the RAM 43. Operational expressions of "C1−X=W1" and "C1−X=W2" are preliminarily stored in the ROM 42. In detecting the width W1 or W2 of the paper P, the CPU 41 reads the fixed data C1, W1 and W2 and the operational expressions "C1−X=W1" and "C1−X=W2" from the ROM 42 and the movement quantity X from the RAM 43, and then executes at least one of the operational expressions "C1−X=W1" and "C1−X=W2", thereby determining whether the width of the paper P set is W1 or W2.

Thus, the paper width detecting means 10 is comprised of the paper lateral end sensor 11, the CPU 41, the ROM 42, and the RAM 43.

The CPU 41 constituting the paper width detecting means 10 has a function of driving the CA motor 55 to move the carrier 3 from the home position HP to the right, and returning the carrier 3 to the home position HP after the detection of the paper width, a function of writing a count value from the encoder pulse counting circuit 33 into the RAM 43, and a function of latching the count value at the time when the left end of the paper P is detected by the paper lateral end sensor 11, and converting this count value into the movement quantity X of the carrier 3 from the home position HP.

Figure 4:
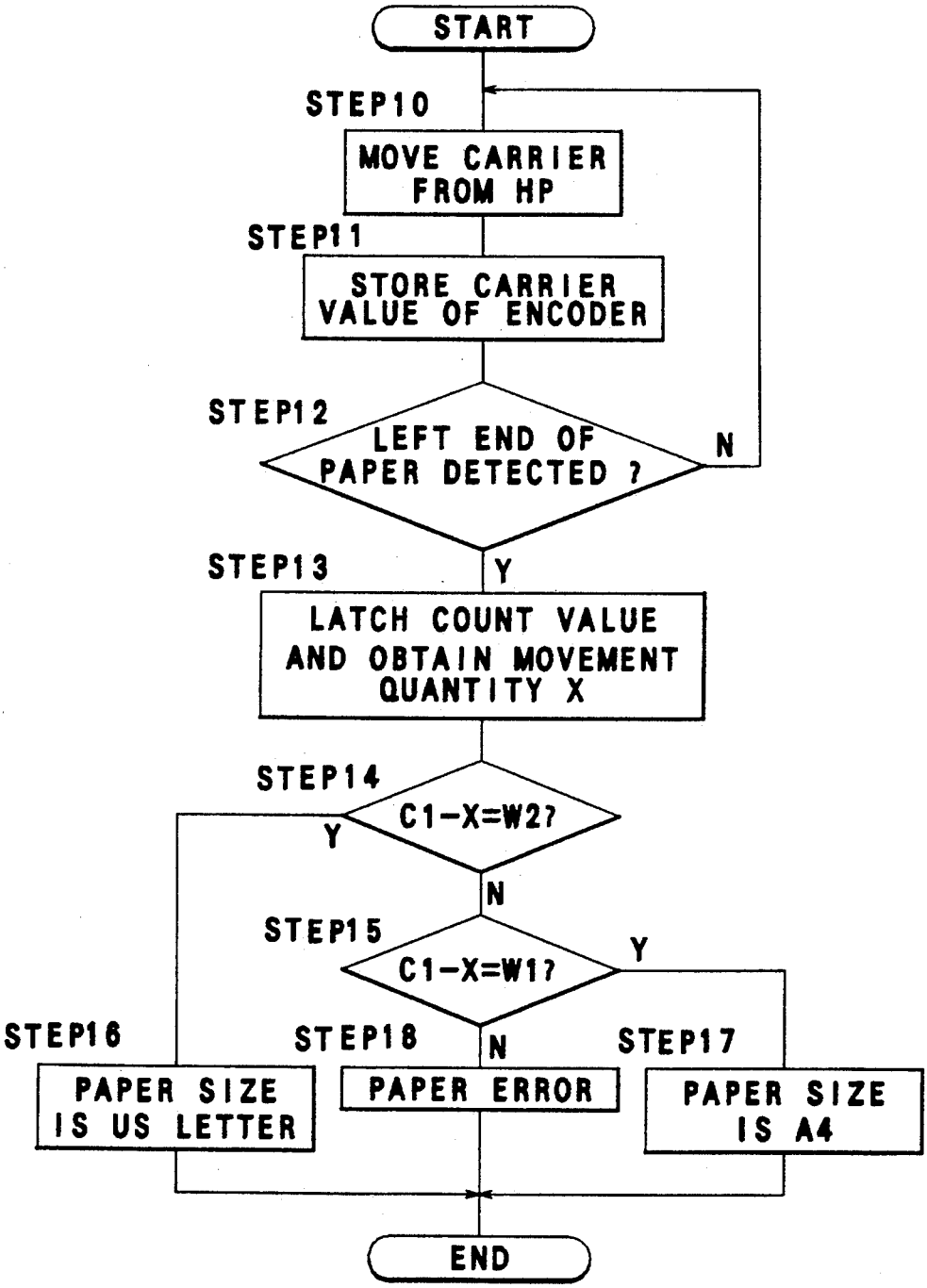
FIG. 4 is a flowchart of the paper width detecting operation.

Now, the operation of the preferred embodiment will be described with reference to the flowchart shown in FIG. 4.

It is assumed that the paper P having the US letter size is subjected to printing. In this case, the movable plate 7 is set in a position shown by a solid line in FIGS. 2 and 3 so that the left end of the paper P may be kept in contact with the movable plate 7 and the right end of the paper P may be kept in contact with the fixed plate 6.

When receiving a command signal, the CPU 41 starts to rotate the CA motor 55 and once return the carrier 3 to the home position HP. Then, the CPU 41 controls to rotate the CA motor 55 and move the carrier 3 from the home position HP to the right as viewed in FIG. 2 (ST 10).

When the carrier 3 is returned to the home position HP, the count value of the encoder pulse counting circuit 33 constituting the movement quantity detecting means 30 is cleared to zero. Subsequently, in association with the rightward movement of the carrier 3, the encoder pulse counting circuit 33 starts to count pulse signals from the home position HP. This count value is stored into the RAM 43, and it is converted into the movement quantity X by the CPU 41 (ST 11).

When the paper lateral end sensor 11 detects the left end of the paper P to become on (YES in ST 12), the CPU 41 latches the count value and obtains the movement quantity X corresponding to this count value. This movement quantity X is stored into the RAM 43 (ST 13).

Then, the CPU 41 reads the fixed data C1, W1 and W2 and the operational expressions "C1−X=W2" and "C1−X=W1" from the ROM 42 and the movement quantity X from the RAM 43, and executes the operational expression "C1−X=W2" to determine whether or not the equation is satisfied in ST 14. Since the answer in ST 14 is YES in this case, the size of the paper P is determined as the US letter size (ST 16).

In the case that the paper P having the A4 size is set, the answer in ST 14 becomes NO, and the operational expression "C1−X=W1" is executed in ST 15 to determine whether or not the equation is satisfied. Since the answer in ST 15 is YES in this case, the size of the paper P is determined as the A4 size (ST 17). Further, in the case that the paper P having any sizes other than the U.S. letter size and the A4 size is set, the answer in ST 15 becomes NO, and the size of the paper P is determined as error (ST 18).

After thus automatically determining the size of the paper P, the CPU 41 transfers the result of determination through the interface 44 to a host computer.

In the paper width detecting operation as mentioned above, when the paper lateral end sensor 11 detects the left end of the paper P to become on, the CPU 41 controls to reversely rotate the CA motor 55 and return the carrier 3 to the home position HP. Further, the CPU 41 operates to add the fixed distance C2 to the movement quantity X at the time of execution of ST 13, thereby obtaining the print start position PSP. This print start position PSP is stored into the RAM 43.

Thereafter, when print data is input from the host computer, the CPU 41 controls to develop the print data in accordance with the size of the paper P determined above (e.g., U.S. letter size) and drive the CA motor 55, the printing head 4, etc. in concert with each other, thus starting printing from the print start position PSP.

According to the above preferred embodiment, the movable plate 7 of the paper lateral ends positioning mechanism 5 is located on the home position HP side, and the fixed plate 6 of the paper lateral ends positioning mechanism 5 is located on the other side opposite to the home position HP side. In connection with this arrangement, the paper width detecting means 10 is so designed as to automatically detect the paper width W1 (W2) by subtracting from the known distance C1 the movement quantity X of the carrier 3 from the home position HP at the time when the left end of the paper P is detected by the paper lateral end sensor 11. Accordingly, the paper width detection time can be greatly reduced to thereby realize a high printing speed.

Further, the paper width detecting means 10 including the paper lateral end sensor 11 is constructed by utilizing conventional components, that is, the components 41, 42, etc. of the control section 40, the movement quantity detecting means 30, and the home position detecting means 20. In other words, the paper width detecting means 10 can be realized easily at low costs by reversing the locations of the movable plate 7 and the fixed plate 6 and slightly modifying a software for paper width detection.

Further, the print start position PSP can be obtained only by adding the fixed distance C2 to the movement quantity X of the carrier 3 at the time when the left end of the paper P is detected by the paper lateral end sensor 11. Accordingly, as compared with the prior art shown in FIG. 5 wherein the print start position PSP is determined as the movement quantity X equalized to the constant (C1+C2), a processing time is not so different, but rather advantageous for improvement in printing speed because one determination step can be reduced.

Although the home position HP is defined on the left side as viewed in FIG. 2, it is to be understood that the home position HP may be defined on the right side according to the present invention.

What is claimed is:

1. A printer comprising:

a paper lateral ends positioning mechanism comprising a fixed plate and a movable plate;

a carrier comprising a paper lateral end sensor, the carrier moving from a home position toward the movable plate and the fixed plate, wherein a distance between the movable plate and the home position is less than a distance between the fixed plate and the home position; and paper width detecting means for calculating a width of a paper sheet placed between the fixed plate and the movable plate, by subtracting a first quantity of a distance of movement of the carrier from the home position to a position where the lateral end sensor detects a lateral end of the paper sheet placed between the fixed plate and the movable plate from a second quantity of a known distance between said home position and said fixed plate.

2. The printer according to claim 1, further comprising:

a memory for storing data of at least one paper width; and comparing means for comparing the width of the paper sheet placed between the fixed plate and the movable plate as detected by the paper width detecting means and the stored at least one paper width data.

3. The printer according to claim 2, further comprising:

error signal generating means for generating an error signal when the paper width of the paper sheet placed between the fixed plate and the movable plate as detected by the paper width detecting means does not correspond to any of the at least one stored paper width data.

* * * * *